US005209391A

United States Patent [19]

Krautsack

[11] Patent Number: 5,209,391

[45] Date of Patent: May 11, 1993

[54] COLLAPSIBLE PAPERBOARD CONTAINER

[75] Inventor: Richard G. Krautsack, North Barrington, Ill.

[73] Assignee: Comark Merchandising, Inc., Elk Grove Villange, Ill.

[21] Appl. No.: 847,650

[22] Filed: Mar. 5, 1992

[51] Int. Cl.[5] ..... B65D 5/36; B65D 5/56

[52] U.S. Cl. ..... 229/104; 206/45.19; 229/110; 248/174

[58] Field of Search ..... 229/104, 110, 120.21, 229/137; 206/44 R, 45.19, 45.27; 248/150, 152, 174

[56] References Cited

U.S. PATENT DOCUMENTS

| | | | |
|---|---|---|---|
| 1,281,501 | 10/1918 | Brown | 248/174 |
| 1,580,147 | 4/1926 | McClean | 229/104 |
| 1,904,365 | 4/1933 | Geist | 229/104 |
| 2,091,291 | 8/1937 | Ringler | 229/137 |
| 2,713,984 | 7/1955 | Paige | 248/174 |
| 2,715,509 | 8/1955 | Paige | 229/104 |
| 3,300,166 | 1/1967 | Wojciechowski | 248/174 |
| 3,384,222 | 5/1968 | Franco | 229/104 |

FOREIGN PATENT DOCUMENTS

| | | | |
|---|---|---|---|
| 91/01665 | 2/1991 | PCT Int'l Appl. | 248/174 |

*Primary Examiner*—Gary E. Elkins
*Attorney, Agent, or Firm*—Fitch, Even, Tabin & Flannery

[57] ABSTRACT

Container apparatus is formed of integral paperboard and has a tubular body formed by a series of foldably interconnected sidewalls to form a hollow passageway between open ends. An internal divider wall is formed in the passageway between the open ends by a simple folding of the tubular body.

1 Claim, 4 Drawing Sheets

COLLAPSIBLE PAPERBOARD CONTAINER

BACKGROUND OF THE INVENTION

1. Field of the Invention

The present invention pertains to paperboard containers erected from a flat blank, in particular to such containers forming a freestanding, self-supporting structure.

2. Description of the Related Art

There is a wide variety of display structures in use today. Such structures are frequently employed for retail sales, and must be capable of installation in different locations in a store, including floor space in the center of a floor. Shelf and display bins, for example, are frequently formed of plural components which are assembled by store personnel for a particular promotion.

SUMMARY OF THE INVENTION

A self-erecting structure would offer advantages of customer acceptance due to the ease of assembly, and the avoidance of following complicated assembly instructions. Certain economies of manufacture can be attained if the structure can be formed from a unitary paperboard blank, which is folded and scored in such a manner as to suggest or aid in the container erection.

It is an object according to the present invention to provide a display container of paperboard material, which is free standing and self supporting.

A further object according to the present invention is to provide a container of the above-described type, which is fabricated from an integral paperboard blank, and which is quickly and easily erected by expanding the blank, and which may be stored by collapsing the device into a flat package.

Yet another object according to the present invention is to provide a container of the above-described type having multiple configurations so as to provide dual modes of operation for a user.

These and other objects according to the present invention, which will become apparent from studying the appended description and drawings, are provided in a container apparatus formed from an integral paperboard blank comprising a tubular body formed by a series of foldably interconnected sidewalls, said tubular body having a pair of opposed, open ends and a hollow passageway therebetween divided by an internal divider wall.

DETAILED DESCRIPTION OF THE PREFERRED EMBODIMENT

Figure 1:
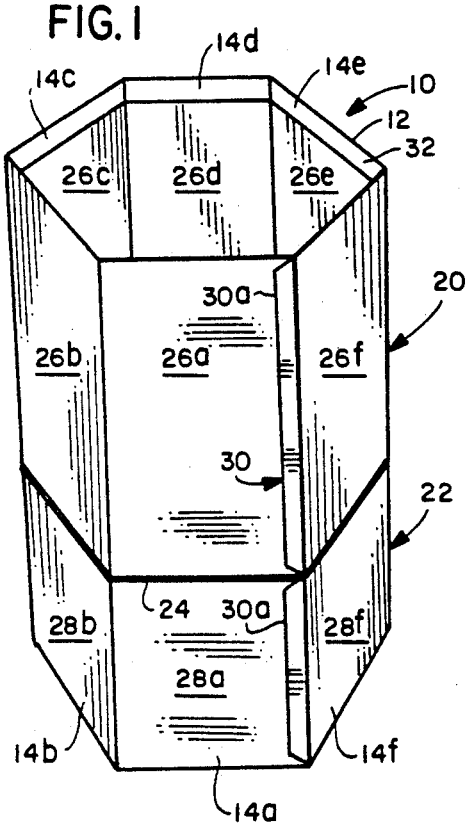
FIG. 1 is a perspective view of a container according to principles of the present invention.
Figure 2:
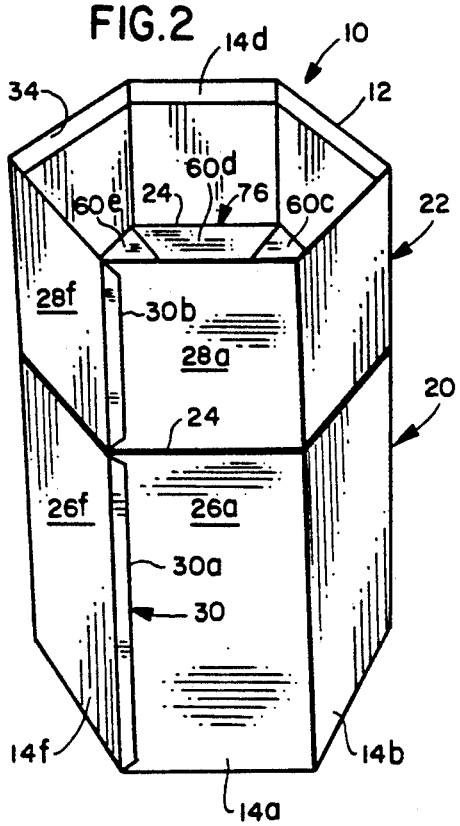
FIG. 2 is a perspective view thereof, showing the container in an inverted position.

Referring now to the drawings, and initially to FIG. 1, a paperboard container is generally indicated at 10. The container 10 includes a tubular body 12 having six sidewalls 14, forming a body of hexagonal cross-section. As will be seen herein, the present invention applies to tubular bodies of differing cross-sectional shapes, and with differing numbers of sidewalls. The sidewalls, and the tubular body, are divided into upper and lower portions. In the preferred embodiment, the tubular body 12 is divided by an internal divider wall into upper and lower body portions 20, 22, preferably of similar cross-sectional size and shape, but having differing axial lengths. For example, the body portion 20 of FIG. 1 is longer than the body portion 22, an arrangement which can also be seen in FIG. 2 where the container 10 is shown in an inverted position, with a tubular body portion 22 located above the tubular body portion 20. As can be seen in FIGS. 1 and 2, a seam 24, formed by the folded construction of the internal divider wall is located between the body portions 20, 22. The seam 24 extends through each sidewall 14, dividing the sidewall into opposed portions 26, 28. For example, a sidewall **14*a* is located to one side of a manufacturer' joint 30 which includes flaps 30*a*, 30*b*. The sidewall 14*a* is divided into sidewall portions 26*a*, 28*a*, separated by the seam 24**.

Figure 3:
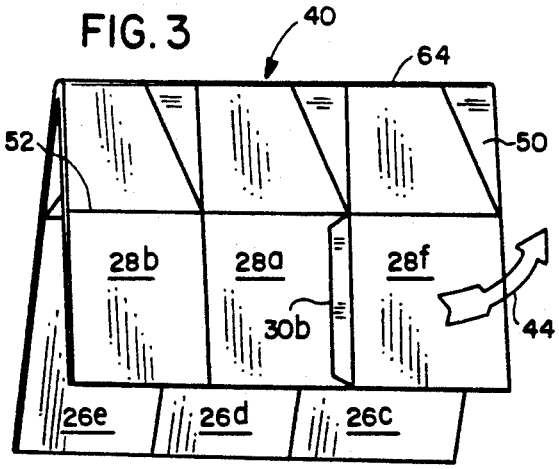
FIGS. 3–10 show a sequence of steps in erecting the finished carton of FIG. 10, from the folded blank of FIG. 3.
Figure 14:
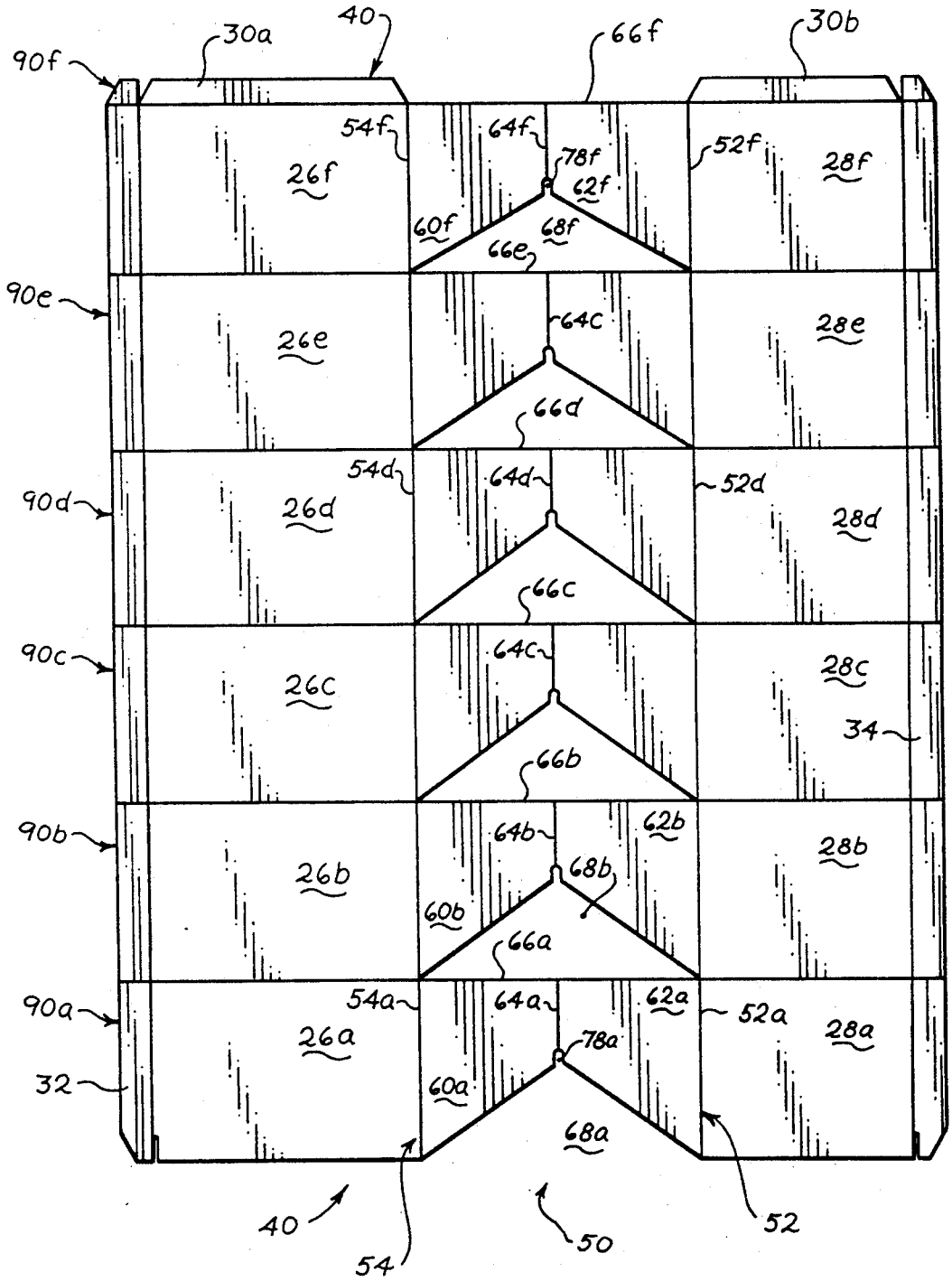
FIG. 14 is a top plan view of a carton blank from which the carton of the preceding figures is constructed.

Referring now to FIG. 3, the carton 10 is preferably erected from an integral folded blank generally indicated at 40 and which is shown in greater detail in FIG. 14. The blank is folded along line 42 for ease of shipment, and arrives at an end user in the condition illustrated in FIG. 3. The panel is unfolded in the direction indicated by arrow 44 of FIG. 3 to assume the position illustrated in FIG. 4, that of a collapsed tube. FIG. 5 shows the reverse side of the collapsed tube. The collapsed tube is then opened in the manner illustrated in FIGS. 6–9, to be explained herein.

Figure 4:
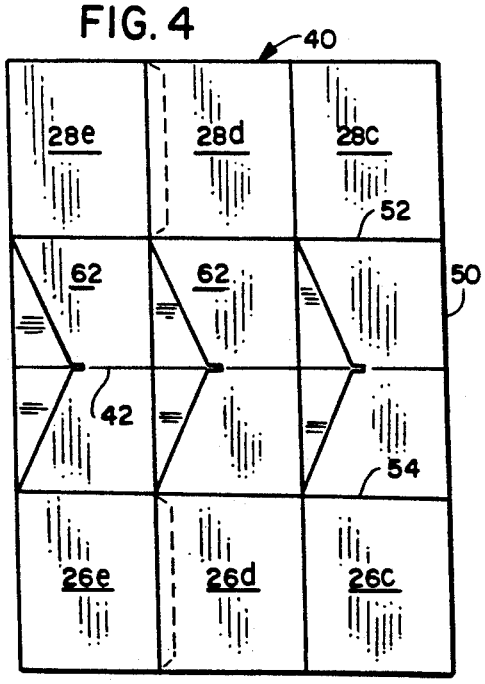
Figure 5:
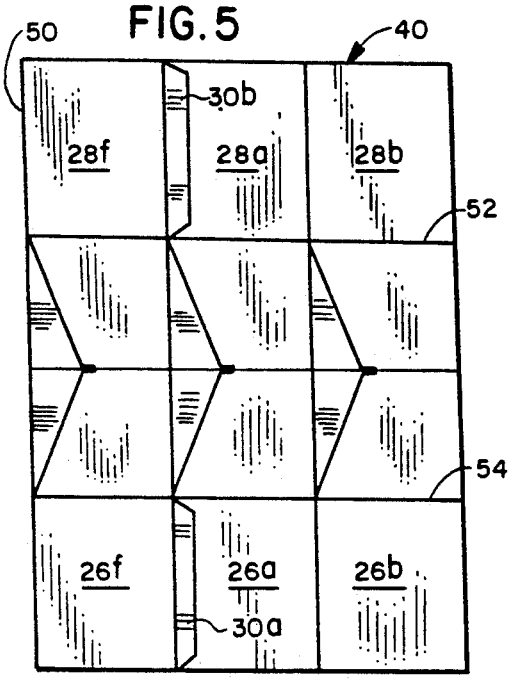

As can be seen in FIGS. 4 and 14, the blank 40 includes a mid-portion 50 located between the sidewall panels **26*a*–*f* and 28*a*–*f* forming the tubular body portions 26, 28. The mid-portion 50 is separated from the wall panels 28*a*–*f* of tubular body portion 28 by a fold line 52 and a fold line 54 divides the central body portion 50 from wall panels 26*a*–*f* comprising the tubular body portion 26. As will be seen herein, the fold lines 52, 54 are butted one against the other as container 10 is erected, and together form the seam 24 illustrated in FIGS. 1 and 2**.

Turning now to FIG. 14, the blank 50 is divided into a consecutive series of wall sections **90*a*–90*f*. Each wall section includes (see the central section 50 of blank 40) a repetition of substantially identical divider panels associated with each wall section,i.e., each sidewall of the container. For example, divider panels 60*f*, 62*f* are located between sidewall panels 26*f*, 28*f*. The divider panels 60*f*, 62*f* are hingedly connected at 64*f* so as to form a construction having a first generally straight edge 66*f* and a generally triangular-shaped opening 68*f*. Panel 60*f* is hingedly connected to side panel 26*f* by a fold line 70*f* and panel 62*f* is hingedly connected at 72*f* to side panel 28*f*. The construction is repeated for the five remaining sidewall panel constructions of blank 40. FIG. 14 shows an inside view of blank 40**, illustrating the inside surfaces of a completed container. Thus, when the blank is folded into a tube, the triangular opening 68*a* at one end of blank 40 is enclosed by edge 66*f* located at the opposite side of the carton blank.

According to one aspect of the present invention, the fold lines 64*a*–64*f* are co-linearly aligned preferably at a midpoint between generally parallel fold lines 52, 54. As a further preference, the straight edges 66*a*–66*f* continue along respective pairs of adjacent panels 26 and 28. For example, the edge 66*a* extends between panels 26*a*, 26*b* and also extends between neighboring panels 28*a*, 28*b*. As mentioned, in the preferred embodiment, six sidewalls are provided and configured so as to form an hexagonal shape. Accordingly, the panels 26*a*–26*f* have generally identical lateral dimensions, which preferably are equal to the lateral dimensions of panels 28*a*–28*f*.

Figure 11:
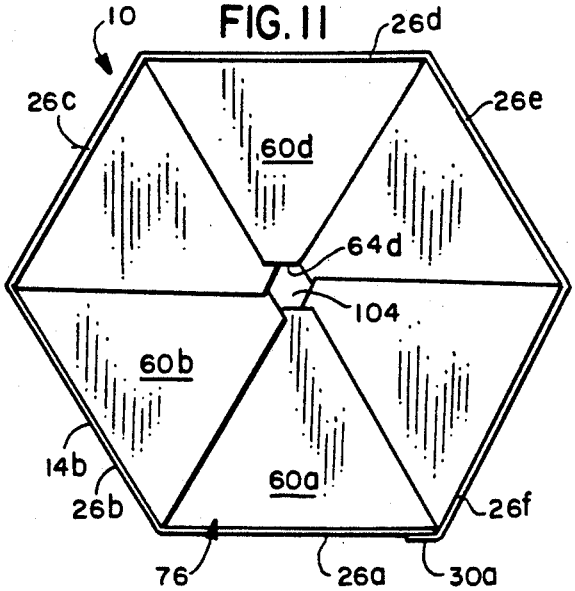
FIG. 11 is an end view of the fully assembled carton of FIG. 10.

In use, the divider panels 60, 62 are folded one against the other in a partially overlapping mode to form an internal divider wall generally indicated at 76 (see FIG. 11). Finger-like recesses 78*a*–78*f* are formed at the apex of the triangular cutout portions 68*a*–68*f*, at fold lines 64*a*–64*f* to aid in an inter-nesting of the divider wall panels 60, 62. The inter-nesting, illustrated in FIGS. 12 and 13, will be explained in greater detail, below.

Referring again to FIG. 14, it can be seen that the present invention provides an efficient blank layout for blank 40, which is simple and easy to design for different sized and different shaped containers and which minimizes die maintenance when manufacturing large numbers of carton blanks. The blank 40, as can be seen, is laid out on a relatively simple rectangular grid format with six rows corresponding to the sidewalls of the container, and four columns. As mentioned in the preferred embodiment, two extra columns are added to blank 40, to provide fold-over reinforcement at the opposed open ends of the tubular body. Thus, each row of blank 40, corresponding to a sidewall of the container, is comprised of four section panels extending in an axial direction including sidewall panels at the outer ends of the row and a pair of opposed divider panels in the center of the row.

Figure 6:
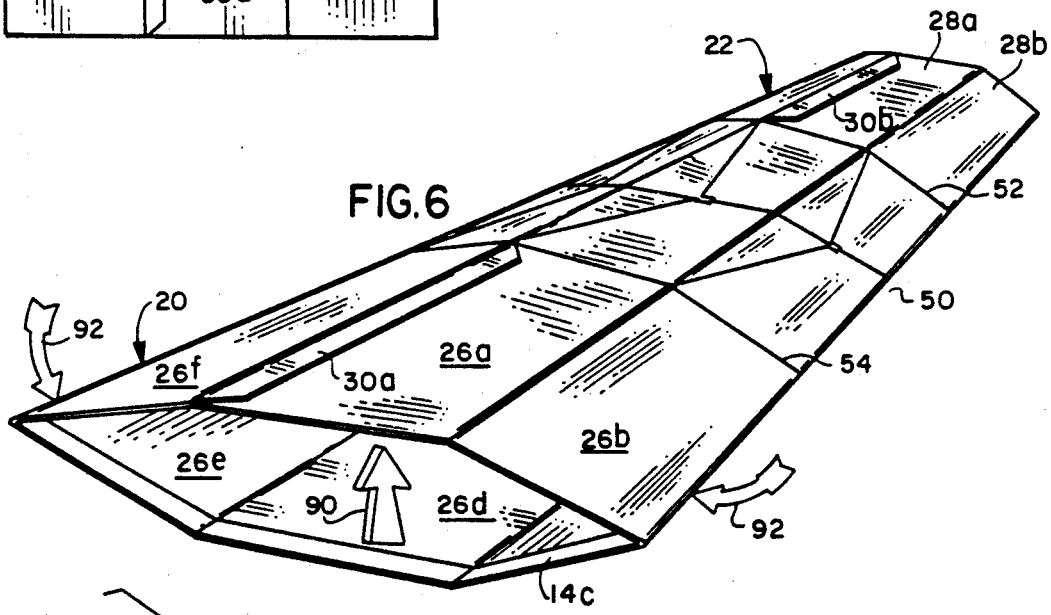

Referring again to FIG. 3, the blank 40 is preferably folded along fold line 64, which joins the divider panels 60, 62. After opening the folded blank in the direction of arrow 44, the flattened tube of FIGS. 4 and 5 is made ready for the expanding of the collapsed blank, as illustrated in FIG. 6. The opposed sidewalls of the blank are moved apart in the direction of arrow 90, and if desired, the opposed edges of the folded blank can be compressed as indicated by arrows 92. The expanded blank now assumes a tubular shape, and preferably is placed on a floor, with the central axis of the tube in a generally vertical direction as illustrated in FIG. 7.

Figure 7:
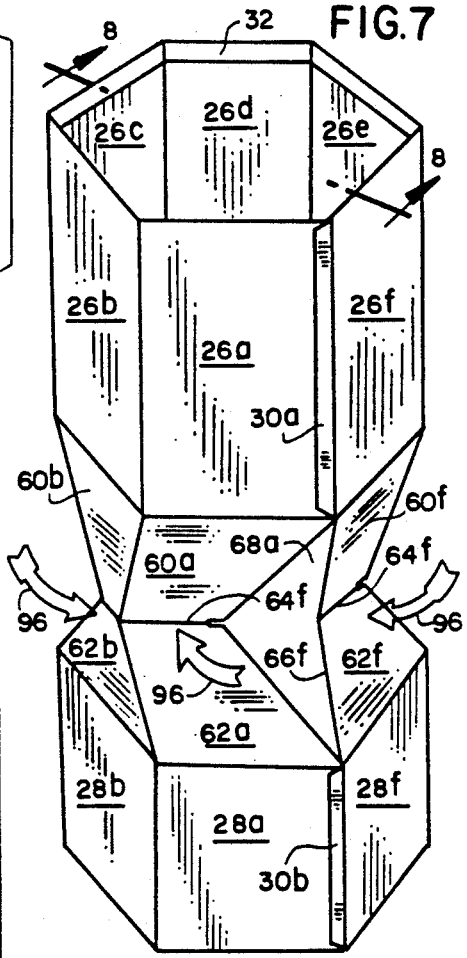
Figure 9:
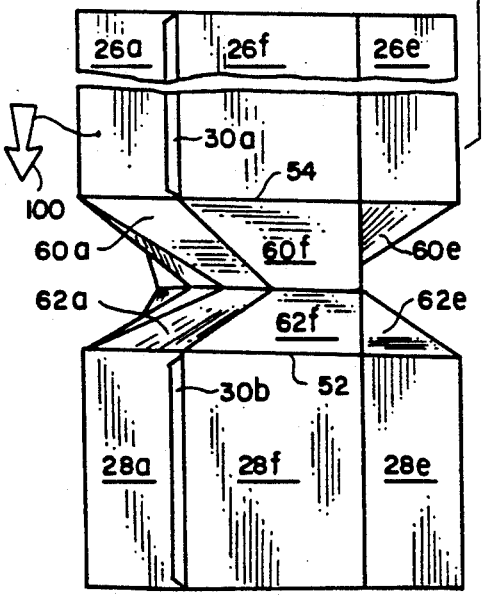
Figure 10:
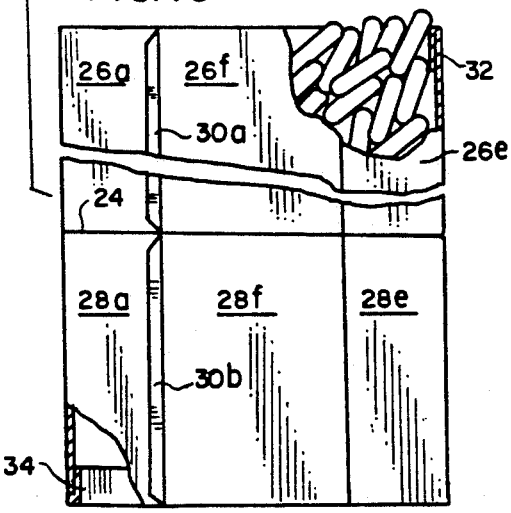

Next, the several divider panels 60, 62 are collapsed against each other, being moved with the fold lines 64 displaced toward the tube's central axis, as indicated by arrows 96 in FIG. 7. Once the folding of the divider panels 60, 62 is begun, the tube begins to collapse in an axial direction with the divider walls separating the container portions 26, 28 being formed as pairs of adjacent panels 60, 62, which are brought into contact with one another. The top and bottom portions of the container may be compressed together as indicated by arrows 98 of FIG. 8 or, preferably, with the tubular blank resting on the floor, the uppermost body portion is compressed in a downward direction, as indicated by the arrow 100 of FIG. 9. As indicated in FIG. 9, an acute angle between pairs of divider panels 60, 62 becomes smaller as the container portions 26, 28 are brought together, and approaches a very small or zero degree angle when the container is fully formed, in the manner indicated in FIG. 10. As mentioned, the seam 24 indicated in FIG. 10 is comprised of the butted joinder of fold lines 52, 54 which are brought together when the tube is collapsed in an axial direction.

Figure 12:
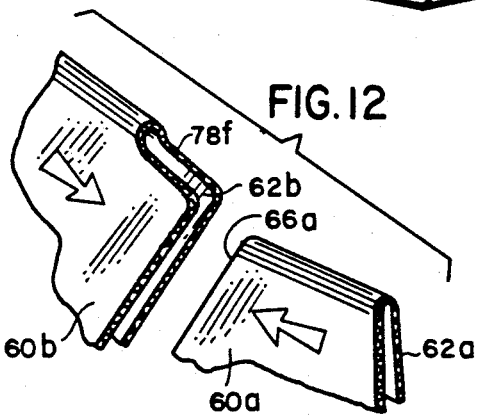
FIG. 12 is a perspective view showing interlocking of the wall portions internal to the carton.
Figure 13:
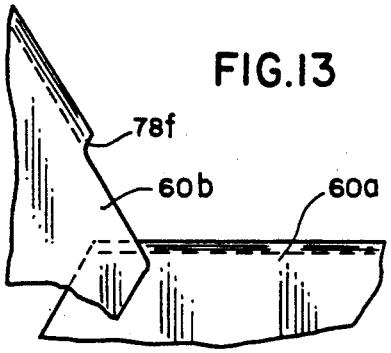
FIG. 13 is a fragmentary view showing a portion of the center of FIG. 11.
Figure 8:
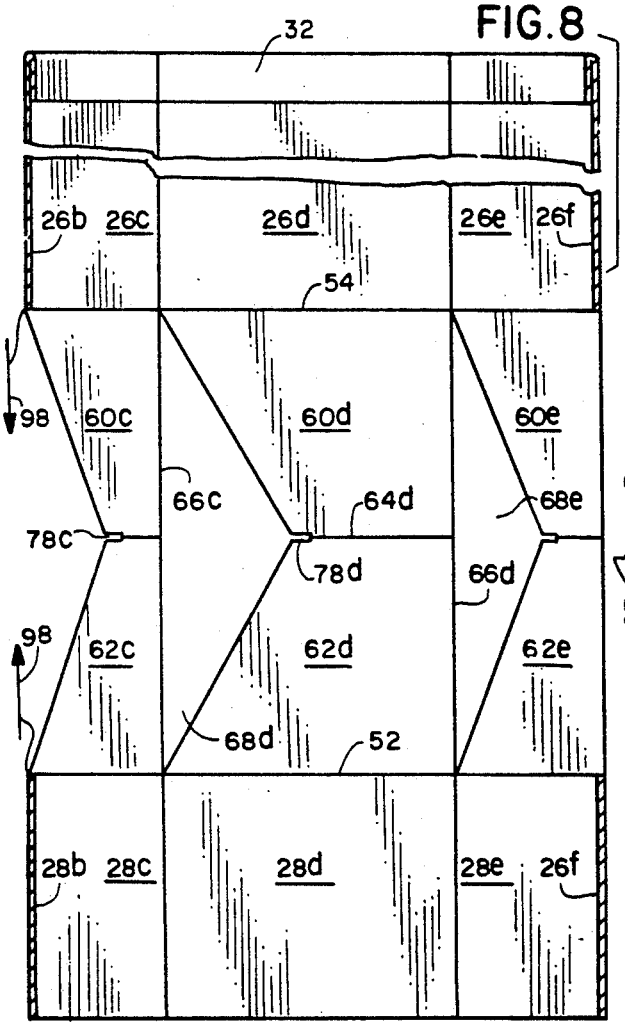

As can be seen in FIGS. 7 and 9, the central divider walls are extended toward the central axis of the tube, as the opposed container portions of the tube are brought together. However, owing to the triangular cutouts 68 described above, the contacting portions of adjacent internal divider walls take on a wedging action as neighboring divider walls undergo interleaving engagement, as illustrated in FIG. 13. As shown in FIG. 12, the straight edge portion 66*a* of one internal divider wall panel is nested between the wall panels 60*d*, 62*b* of its adjacent neighbor. This interleaving, iris-like engagement of the internal divider walls takes place substantially at the same time in all of the several divider wall panels as the tube portions are brought together. The resulting divider wall construction is illustrated in FIG. 11 and a portion of the wall is visible in FIG. 2. In the preferred embodiment, a small opening 104 is located at the center of the dividing wall. The size of the opening 104 is, however, quite small compared to the dimensions of the container and has not been found to be a problem when merchandise is displayed in the container portions, as indicated in FIG. 10.

As will now be appreciated, the bin portions provided by container 10 are substantially identical, except for the depth of those bin portions. Accordingly, the container 10 can be inverted to assume one of the positions indicated in FIGS. 1 and 2 to provide bins of two different depths. Further, those skilled in the art will readily appreciate that with only simple modifications to blank 40, bins of other, different depths can be readily provided.

As mentioned, in the preferred embodiment, the central divider wall comprised of panels 60, 62 preferably extends at a generally right angle to the central axis of the tubular body and, thus, the "floor" of each bin compartment (either as a deeper bin compartment upwardly facing in FIG. 1, or the shallower bin compartment upwardly facing in FIG. 2) is provided with a generally horizontal support surface. If desired, however, the central portion 50 of blank 40 can be extended, with the two central columns being widened, so that tubular body can be left partially compressed, approximately as shown in FIG. 9 with the internal divider walls meeting to close gaps therebetween and to provide an overlapping, interleaving of the type illustrated in FIG. 11. This alternative arrangement will provide generally conical "floor" supports for each bin compartment and again the floor of each bin compartment will have a similar configuration due to the preferred symmetry of construction. In this alternative arrangement, a band of paper or paperboard can be wrapped about the gap between container portions to alter the aesthetic appearance of the container. Also, if desired, a similar banding or even a wrapping of adhesive tape can be laid over seam 24 (see FIGS. 1 or 2, for example) to alter the aesthetic appearance of the container, and optionally to prevent unintentional expansion of the divider wall construction as container 10 is lifted for movement from place to place.

As will now be appreciated, the container 10 according to principles of the present invention provides an attractive free-standing floor display suitable for use in retail merchandising, including point-of-purchase displays. Prototype samples of the container 10 have offered surprising strength and rigidity owing, in part, to the double wall construction of the divider wall, the interleaving of the divider wall panels, and the finger-like cutouts 78 which confine the neighboring divider wall panels and provide an improved wedging engagement therewith.

Since the labor component of both the fabrication and erection of the container are, in many cases, the most costly component of the container, the present invention will now be seen to provide heretofore unattainable commercial advantages. More particularly, the only labor component required to erect container 10 is to provide a manufacturers' joint at flaps 30*a*, 30*b* (and even this labor component can be automated) and simple folding operations indicated in FIGS. 3–9. The relatively simple labor steps involved provide a container of surprising complexity, which, in the preferred embodiment, has 24 wall panels with an iris interleaving of 12 of those panels.

As a further commercial advantage, those skilled in the art will readily appreciate that advertising indicia and the like can be readily applied to the paperboard blank 40 using conventional, cost effective techniques to provide an attractive eye-catching display for retail commercial items. For example, the need for accurate printing registration is greatly reduced when different colors are desired for the top and bottom portions of the container, since, as can be seen in FIG. 14, the sidewall panels 26, 28 are separated by a substantial distance, and yet are joined along a relatively thin seam when the carton is fabricated.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A paperboard blank which is folded to form a tubular body having a pair of opposed, open ends and a hollow passageway therebetween divided by an internal divider wall, comprising:

a consecutive series of wall panel sections, disposed end-to-end and with adjacent wall panel sections joined together by a fold line;

each wall panel section including first and second sidewall panels with a pair of divider panels there between, the pair of divider panels joined together by a fold line and cooperating with an adjacent wall panel section to form a triangular cutout, each wall panel section defining a recess located along the fold line and opening toward the triangular cutout; and the divider panels foldably connected to each other and to the sidewall panels so that upon folding the divider panels of respective ones of said wall panel sections against each other, the sidewall panels of respective ones of said wall panel sections are butted against one another to form respective continuous sidewalls.

* * * * *